United States Patent [19]

Brunn

[11] 4,311,337

[45] Jan. 19, 1982

[54] COMBINATION FURNITURE

[76] Inventor: Oswald Brunn, Bunzlauer Platz 1, D-8000 Munich 50, Fed. Rep. of Germany

[21] Appl. No.: 44,866

[22] Filed: Jun. 4, 1979

[30] Foreign Application Priority Data

Jun. 9, 1978 [DE] Fed. Rep. of Germany ..... 2825408

[51] Int. Cl.[3] ..... A47C 1/124

[52] U.S. Cl. ..... 297/249; 297/440; 297/342

[58] Field of Search ..... 297/440, 443, 249, 248, 297/542, 343, 232; 5/287

[56] References Cited

U.S. PATENT DOCUMENTS

| | | | |
|---|---|---|---|
| 871,022 | 11/1907 | Anthony | 297/440 X |
| 1,292,951 | 1/1919 | Ehoff | 5/287 |
| 2,081,791 | 5/1937 | Bromagem | 297/249 X |
| 2,089,818 | 8/1937 | Terker | 297/440 |
| 3,002,787 | 10/1961 | Ziegenfuss | 297/249 |
| 3,328,075 | 6/1967 | Albinson | 297/248 X |
| 3,494,662 | 2/1970 | Schaefer et al. | 297/248 |
| 3,874,729 | 4/1975 | Blodee | 297/440 |

FOREIGN PATENT DOCUMENTS

| | | | |
|---|---|---|---|
| 156910 | 1/1921 | United Kingdom | 297/342 |

*Primary Examiner*—Francis K. Zugel

*Attorney, Agent, or Firm*—Andrus, Sceales, Starke & Sawall

[57] ABSTRACT

Collapsible combination furniture, which has a rigid basic framework consisting of several frame-like vertical side sections 1 and two cross-ties 2 parallel to each other, these cross-ties being inserted between the front and back supports 1*a* of two side sections and being detachably connected to the supports. Between the side sections 1 there can be inserted, according to choice, a table top, and/or a folding one-seater or several-seater bench seat consisting of a seat section and back section, these being attached to the side sections in a detachable and pivoting manner. The combination furniture is provided with wheels and handles and can be easily moved.

9 Claims, 19 Drawing Figures

Fig. 7
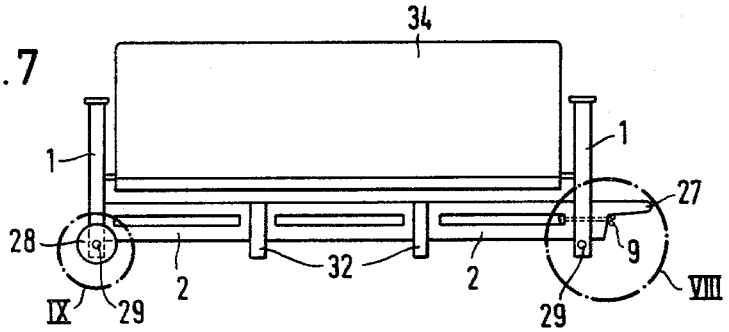
Fig. 8
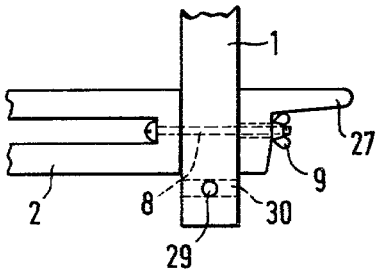
Fig. 9
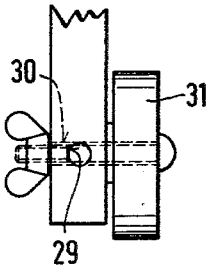
Fig. 10
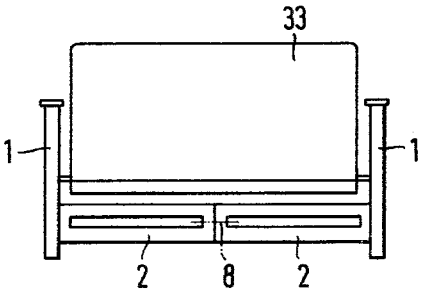
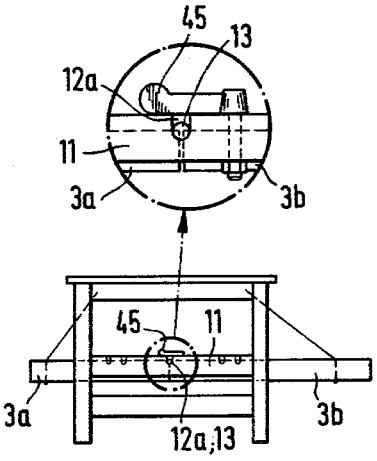
Fig. 11

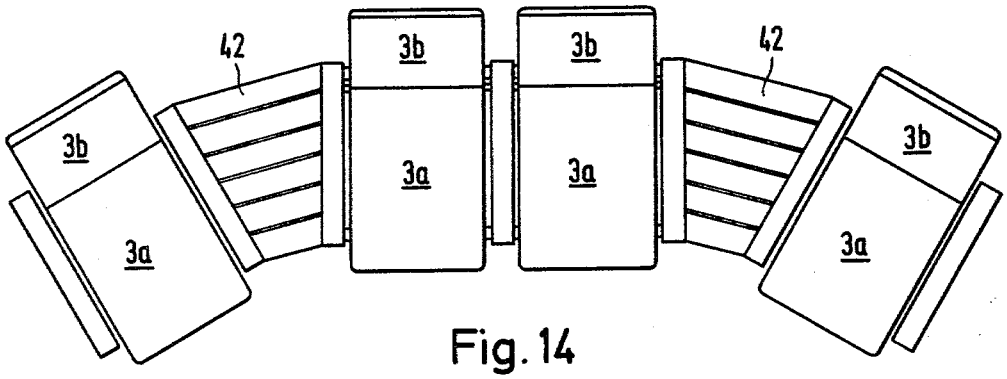
Fig. 14
Fig. 15
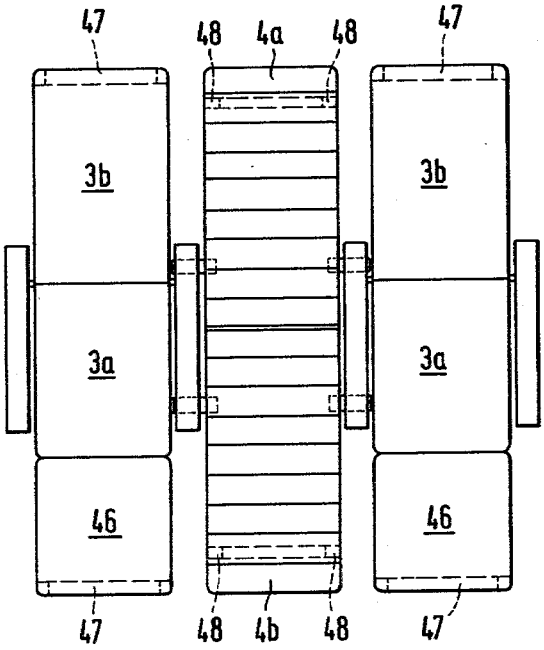

COMBINATION FURNITURE

Combination furniture is already known from German Patentschrift No. 1,779,031. In the arrangement shown in that specification, side sections, to which seats and/or table tops are attached, can be mounted on two longitudinal members connected with each other to form a frame. The number of seats and possible combinations of seats and table tops is thereby determined by the longitudinal members. The combination furniture can be transported in the manner of a wheelbarrow. It can happen, however, that only one or two items of furniture, whether in the form of a table or a seat, are required. In this case, with known combination furniture, the whole framework still has to be used.

From German Patentschrift No. 1,770,030 a furniture assembly is known in which two seats and a table are mounted on a movable base and are detachable from one another and can be used independently. The base fits between the legs of the seat or table. However, with this furniture assembly the seat or table, when removed from the base, are no longer transportable.

On the other hand, the present invention provides combination furniture with an easy, material-saving method of construction formed in such a way that single one-seater or several-seater bench seats or tables can be constructed.

In preferred embodiments of the invention, two side sections are directly detachably connected with each other by means of cross-ties, and thereby form a rigid but always demountable assembly into which either a table top or a chair or a bench seat can be inserted as required. The table or chair can be used in their own right. At both sides additional elements can be added, in that two further cross-ties may be attached to one or each side section, these cross-ties being connected with a further side section.

There are very many possibilities for different combinations, since, for example, the cross-ties can be of differing lengths so that a trapezoidal table top can be fitted, or in particular a bench seat can be constructed. Construction and assembly are extremely simple. In spite of this, great rigidity of the combination furniture is achieved by the construction of the cross-ties and side sections. A single screw is suitable for connecting, this screw being inserted through boreholes on the cross-ties and supports of the side sections.

The chairs and bench seats can be inserted between the side sections in such a way that they can be used in the form of a rocking chair. Instead of a rigid table top a folding table can be installed. The side sections also serve to support a cover for protection against wind and weather and for privacy.

Figure 1:
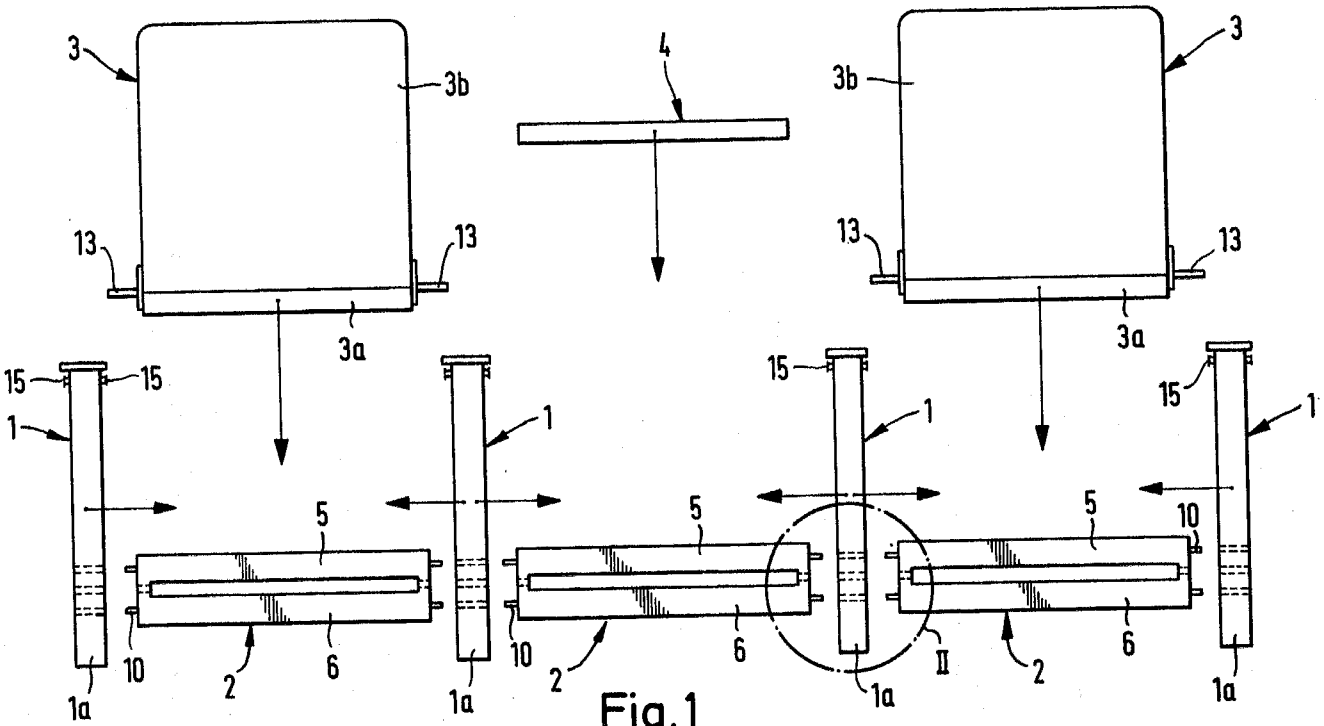
Figure 2:
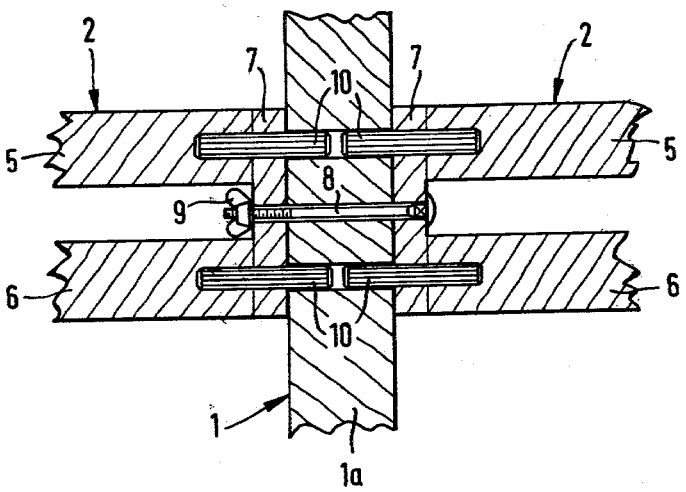
Figures 3, 4:
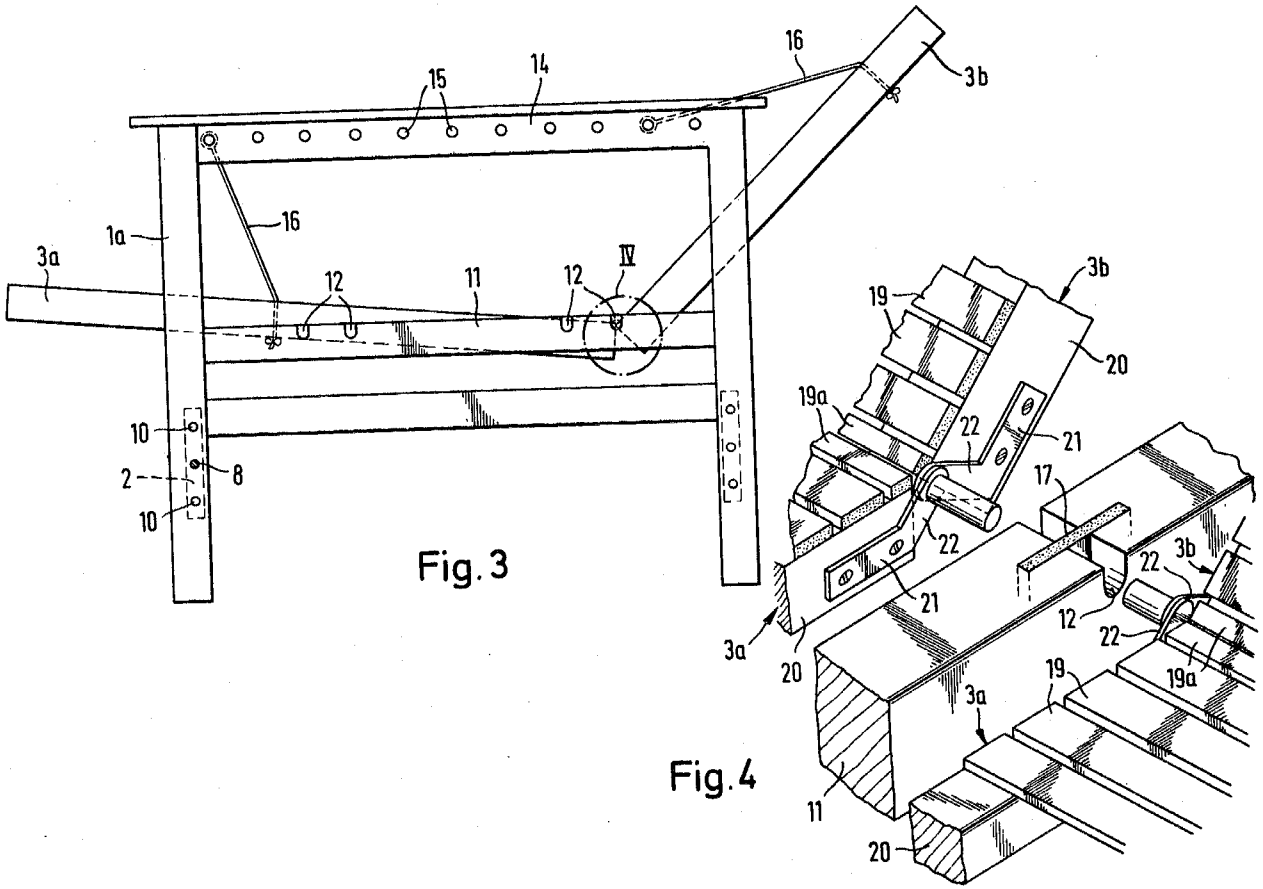
Figure 5:
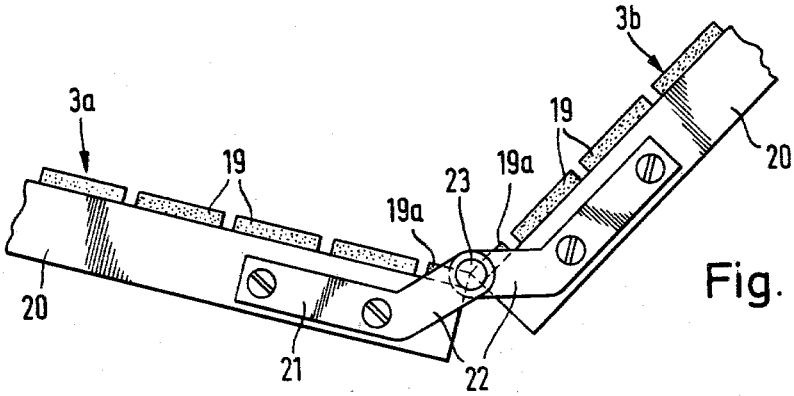
Figure 6:
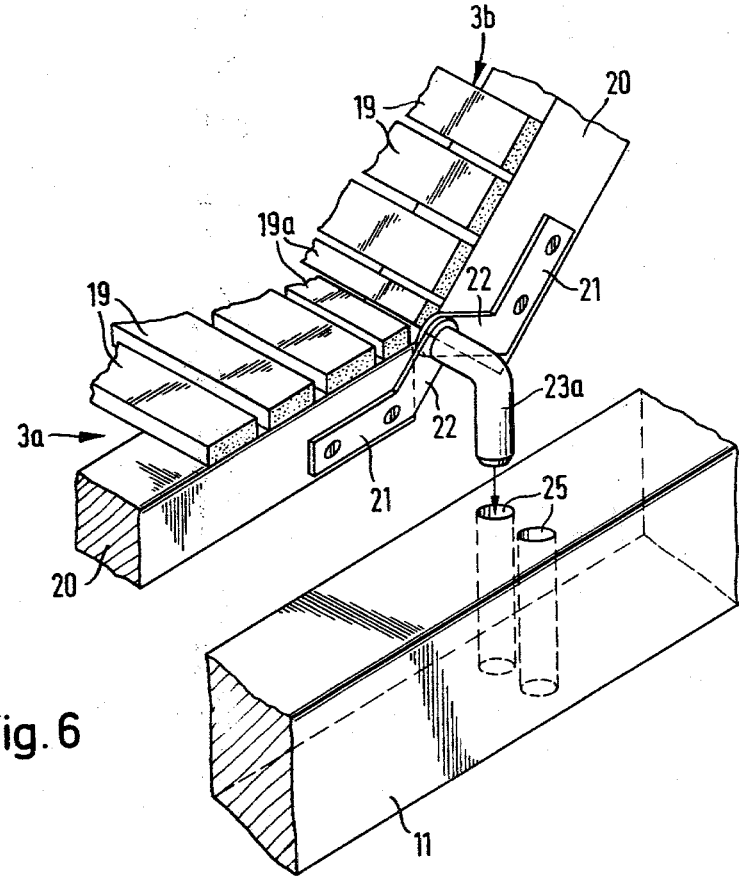
Figure 13:
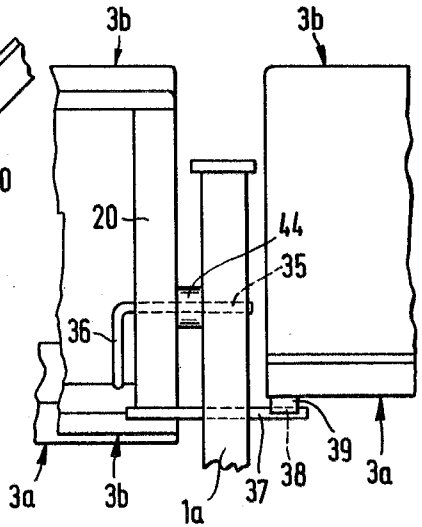
Figure 12:
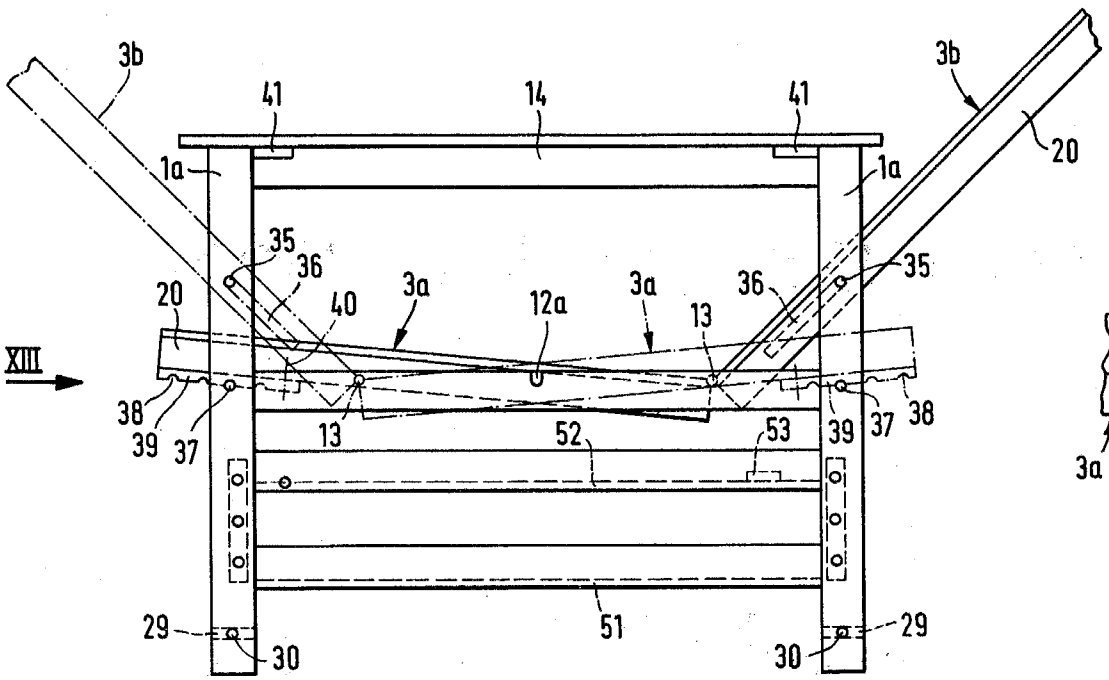

The following is a description of various embodiments of the invention, reference being made to the accompanying drawings in which:

FIG. 1 is a diagrammatically exploded front view of a piece of combination furniture according to the invention consisting of three items of furniture, FIG. 2 shows in greater detail section II of FIG. 1, namely the plug and screw connection between the cross-ties and side sections, FIG. 3 is a side view of the arrangement of a chair in a piece of furniture according to the invention, FIG. 4 is an enlarged perspective view of section IV of FIG. 3, FIG. 5 is a plan view, along the pivot axis, of the pivotal connection between the seat section and back section, FIG. 6 shows a modified plug connection, FIG. 7 is a diagrammatic front view of a further variation in the form of a continuous bench to seat three people, FIG. 8 shows in greater detail section VIII of FIG. 7, namely wheelbarrow handles which can be screwed on, FIG. 9 shows in greater detail section IX of FIG. 7, namely intersecting boreholes for fixing a wheel onto the supports, FIG. 10 is a diagrammatic front view of a variation in the form of a bench to seat two people, FIG. 11 is a side view of a piece of furniture in which the seat section and back section are horizontally hinged, FIG. 12 is a side view of a further form of the invention, which comprises an adjustable or rocking construction for the chair, FIG. 13 shows a detail looking in the direction of the arrow XIII in FIG. 12, FIG. 14 is a diagrammatic plan view of an arrangement with trapezoidal tables, FIG. 15 shows how one and the same piece of combination furniture, in which at first only two chairs and a small table are "in operation", can be extended to such an extent that in all it can form seats for six people with a table of corresponding length.

Figure 16:
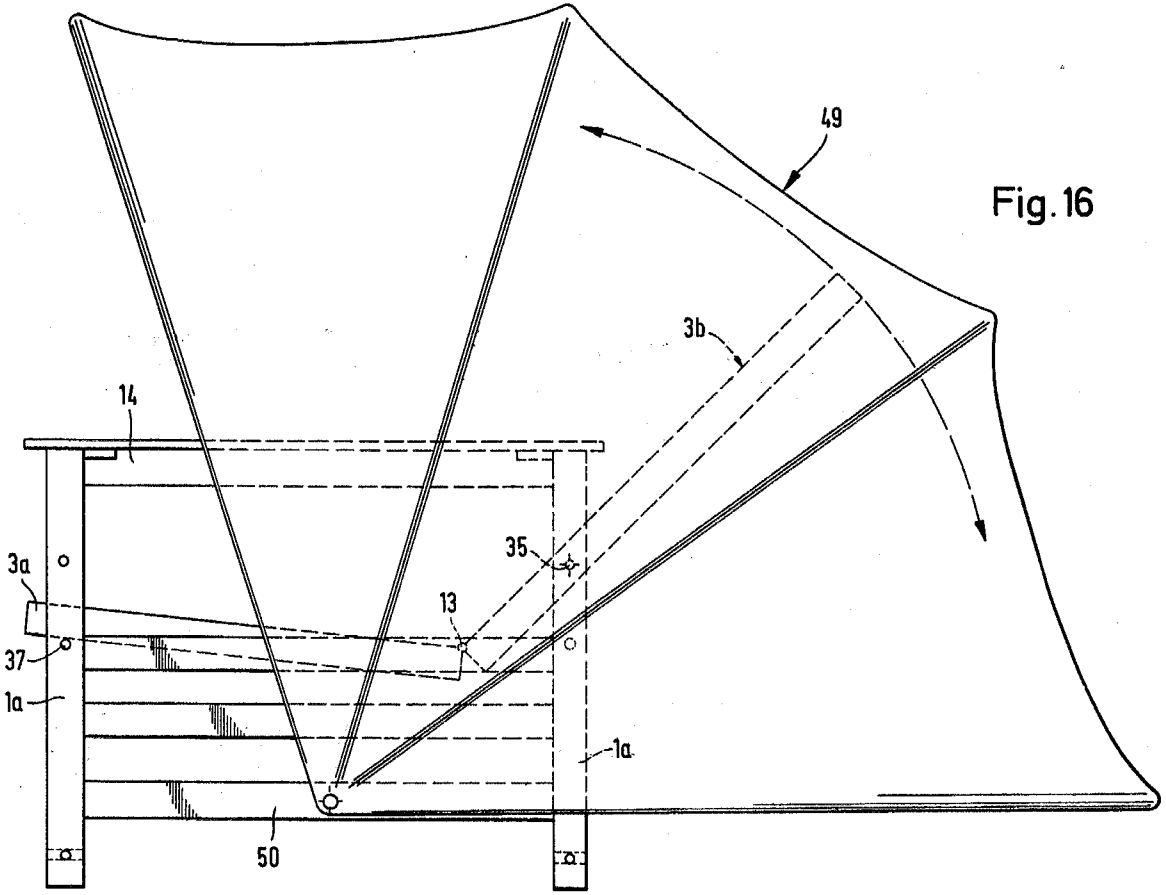
Figure 17:
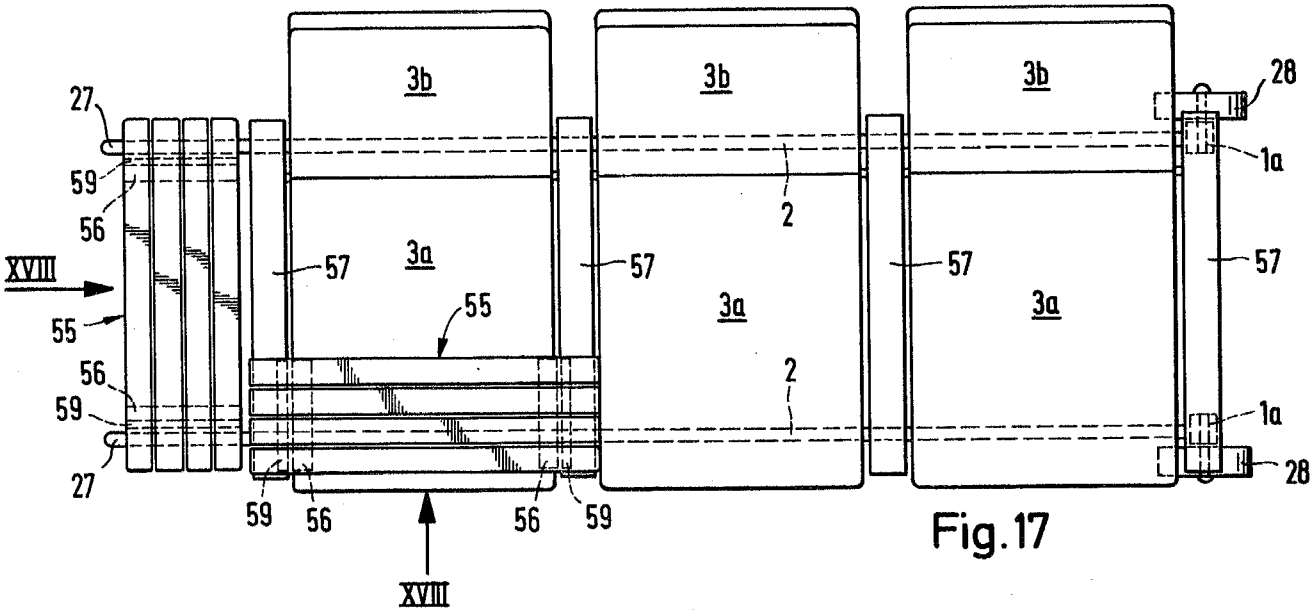
Figure 18:
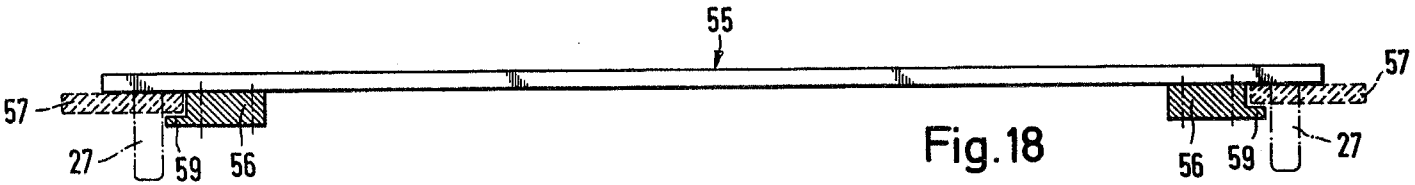
Figure 19:
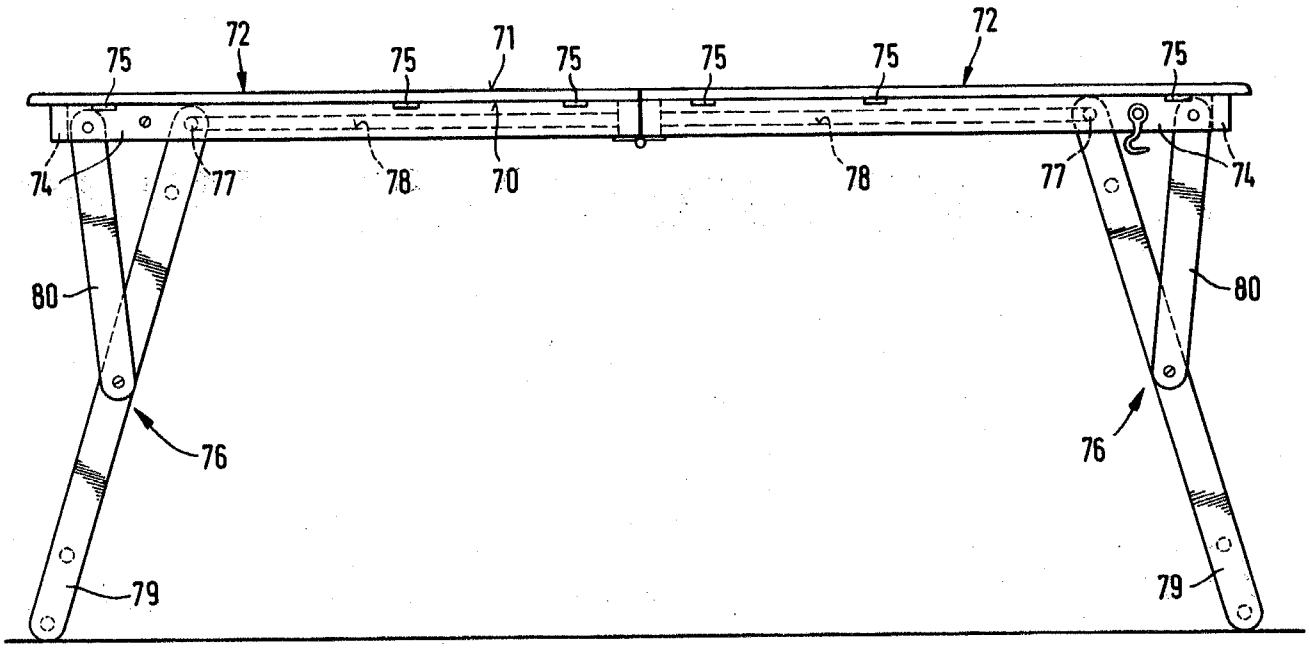

FIG. 16 is a diagrammatic side view of a piece of combination furniture with a wicker covering mounted on it, FIG. 17 is a diagrammatic plan view of a detail, namely a piece of furniture with a detachable tray or table section, FIG. 18 is a combined view, looking in the direction of both arrows XVIII in FIG. 17 at right angles to each other, and FIG. 19 is a side view of a folding table which, when folded up, fits between two side sections.

The components of the combination furniture comprise vertical, frame-like side sections 1 and horizontal cross-ties 2. A seat 3 or a table top 4 is inserted between each pair of adjacent side sections 1. Two or more pieces of furniture of this type can be fitted together side-by-side; every two adjacent pieces of furniture then having one common side section. However, the pieces of furniture can also be used on their own, independent from each other, in which case each piece of furniture, whether it be chair or table, must have two side sections.

In each piece of furniture a cross-tie 2 extends between two front supports and two rear supports, that is, below the chair seat or below the chair top.

As shown in FIG. 2, each cross-tie 2 consists of an upper strut 5 and a lower strut 6, which are held together at each end by a cross piece 7. A borehole extends through the cross pieces 7 and through the supports, through which borehole a screw 8 is inserted and secured by means of a wing nut 9.

Plugs 10 are provided on each cross piece 7 above and below the screw 8, these plugs being inserted in corresponding boreholes in the supports. The ends of the plugs 10 are preferably chamfered as shown.

In this way there is provided an assembly which is easy to erect and extremely rigid and secure.

A strut 11 (FIG. 3) extends between the two supports 1*a* of each side section 1 approximately at the level of the chair seat, on the upper side of which strut there are recesses 12 to receive the laterally protruding ends of pivot pins 23 defining a swivel axis between the seat section and back section. Pairs of such recesses 12 are arranged on each strut 11 at various intervals, into which the protruding pivot pins 23 can be selectively inserted. Buttons 15 are mounted in a row on a strut 14 extending between the upper ends of the supports 1*a*, onto which a tie rod or cable can be fixed, the other end of which is fixed to the seat section 3*a* or back section 3*b*. Thus the seat section 3*a* and back section 3*b* can be adjusted to various sloping positions.

As shown in FIG. 4 each recess 12 has a central partition 17, preferably in the form of an inserted small plate. By this means the protruding ends of the pivot pins 23 are positioned exactly and abutting ends of the pivot pins cannot force one or the other pivot pin out of the recess 12.

The seat section 3*a* and back section 3*b*—and also the table top—are in the form of a slatted board comprising slats 19 and cross-pieces 20. Hinge plates 21 are screwed onto the cross-pieces 20. The hinge plates 21 each have a sloping end which is angled upwards and through which the pivot axis extends. In this way the pivot axis extends at the level of the upper side of the slats 19 and thus practically corresponds with the edges of the directly adjacent slats 19*a* of the seat section and back section respectively. Preferably these adjacent slats 19*a* are half the width of the remaining slats 19.

In the arrangement of FIG. 6, the outer end of each pivot pin 23 is right-angled and holes 25 are provided in the struts 11 of the side sections 1, instead of the recesses 12, into which holes the bent ends 23*a* of the pins can be inserted. This method is an even better guarantee that the ends of the pins cannot slip out of their connection to the struts 11. In FIG. 6 the holes 25 are provided as through bores, so that the weight of the seat can be carried by the horizontal parts of the pivot pins 23 being supported on the struts 11. However, blind holes could also be used, the bent ends 23*a* of the pins 23 then being supported on the bottoms of the holes.

As already explained, the pieces of furniture according to the invention are connected with each other simply, securely and extremely rigidly, so that combination furniture composed of several pieces of furniture can be transported in a wheelbarrow-like manner. For this purpose handles 27 are provided at one end of the furniture (see FIGS. 7, 8 and 9). These handles 27 are fastened on with the same screws 8 and wing nuts as are used for fixing the cross-ties 2 to the supports 1*a*. A wheel 28 is provided on each of the supports opposite the handles 27. The wheels 28 each have a simple knockout spindle which can be inserted into a hole 30 provided in the supports at a suitable height. For this purpose each support is provided with a borehole 29 extending in the seating direction and a borehole at right-angles to it so that a wheel can be fitted as desired (FIGS. 7, 8, 9).

As further shown in FIG. 7, apart from the normally high side sections which each support an armrest, lower side sections 32 are also provided, which extend only to the top edges of the cross-ties 2. In this way it is possible for a bench element 34 consisting of a seat section and back section and seating three people to be provided between the high side sections which are fixed at their ends.

FIG. 10 shows a bench of special width, preferably a two-seater, at the front and back of which two cross-ties are directly connected with each other, that is without a low side section 32 between them, by means of the afore-mentioned screws 8 and wing nuts. A suitably wide bench element 33 is inserted between the side sections 1.

The bench elements 33, 34 can be made rigid, in one piece, or can be made so that the seat section can be tilted relative to the back section. With a hinged formation, the seat section and back section may be pivoted into the same plane, preferably horizontally, as is shown in FIG. 11. The ends of the pivot pins 13 are inserted into recesses 12*a* disposed centrally on the horizontal struts 11 and held there. A horizontal member 45 can be fitted above the pivot pins 13 inserted in the recesses 12*a*, so that the pivot pins are secured in the recesses and thereby the seat and back sections are held securely in the horizontal position.

Otherwise the bench element or bench seat can be formed as shown in FIG. 3 and supported on the furniture assembly.

A further arrangement of the seat section 3*a* and back section 3*b* on the furniture assembly is shown in FIGS. 12 and 13. The back section 3*a* is pivotally mounted on the supports by means of an additional pivot axis located at a higher level than the pivot pins 13. A pivot pin 35 acts as a pivot and is inserted through boreholes provided through the supports and through each cross-piece 20 of the chair back section. An arm 36 at right-angles to the pivot pin 35 serves as a handle for withdrawing and inserting the pin 35. A collar 44 made of flexible material is fitted on each pivot pin 35 between the cross-piece 20 and support 1*a*, this collar serving on the one hand as a spacer and on the other hand to guard against inadvertent loosening of the pivot pins.

The rear edge of the seat section 3*a* is joined by means of the pivot pins 13 to the back section 3*b* and is supported at its front end on a supporting pin 37 which is inserted through a corresponding borehole in the front supports 1*a*. Beneath the cross-pieces 20 of the seat section 3*a* there is a bar 39 formed with a series of recesses 38. The supporting pin 37 is received in an appropriate recess, whereby the seat section 3*a* and back section 3*b* are firmly held at the angle to which they are set. The bar 39 formed with the recesses 38 is removable, and preferably can be swung round an axis 40 towards the rear when not being used. The cross-pieces 20 are then supported with their flat undersides on the supporting pins 37. In accordance with the user's displacement of weight, the cross-pieces 20 will slide over the supporting pins 37, so that, in effect, a rocking-chair is produced. Rollers or sleeves can be placed on the supporting pins 37 on which the cross-pieces 20 roll, in order to decrease friction and thereby facilitate the rocking movement.

The upper struts 14 have recesses 41 into which horizontal members provided on the table-tops can be inserted.

In the arrangement of FIG. 14, two generally trapezoidal table-tops 42 are inserted between two pieces of furniture, and in this way a piece of combination furniture can be provided with chairs placed at an angle to each other. In other respects the trapezoidal table-tops 42 are secured in the same way as square or rectangular table-tops, by means of horizontal members inserted into the recesses 41 on the struts 14.

The table-top placed between two chairs can be in the form of a hinged table as shown in FIG. 15. When in its folded position, the lower half of the table-top 4*a* is folded under the upper half 4b of the table-top. This amount of table space is sufficient if only one chair on each side is provided or is "in operation". If more seating is required, then each back section 3b can be pivoted into the horizontal position and a pair of supports or a support yoke, which are usually folded up and are attached to the upper ends of the back sections, can be swung out to support them from the floor. Thus two further seats are obtained. In a further development an extra section 46 is attached to the front end of each of the seat sections 3a, and this extra section can be folded under the seat section 3a or, if wished, swung out into operational position and then can be supported from the floor by a pair of attached supports 47. This extra section can then, if needed, serve as a further seat. The folding table can now be opened out for the six seating spaces obtained from the two bench seats. Both halves 4a, 4b of the folding table have table legs 48 attached to their free ends.

It is practical for the combination furniture to be used together with a wicker cover. The lower edge of the wicker cover should extend to, or near, floor level. For this purpose, as shown in FIG. 16, the side sections are provided with a cross-tie 50, a relatively small distance above the floor, on which the cover is secured.

As described above with reference to FIG. 12, the back section 3b is attached to the supports 1a by means of pivot pins 35. Thus the upper edge of the back section 3b moves through a circular path, so that the cover can be brought correspondingly close to the article of furniture or can be made correspondingly small.

Each piece of furniture can be fitted with a suitable container for storing utensils. As shown in FIG. 12, a tray 51 is installed at the level of the lower struts 6 and, at around the level of the upper struts 5, a lid 52 is provided which pivots by means of a hinge and can be closed by means of a catch 53. The afore-mentioned extra section may be fitted in the space between the lid and the seat section 3a.

FIG. 17 is a diagrammatic plan view of a piece of combination furniture with a storage tray 55, in which utensils can be stored, placed above its wheelbarrow-like handles 27. This storage tray is formed so that it may also extend between the armrests 57 of a chair to serve as a tray or small table. In FIG. 18 this tray 55 is shown again in both views looking in the directions of the arrows XVIII in FIG. 17. Transverse bars 56 on the lower side of the slatted tray 55 fit between the wheelbarrow-like handles 27. Since the space between the wheelbarrow-like handles 27 corresponds to the space between the armrests 57, the transverse bars of the tray 55 also fit between the armrests 57. In a further improvement of this arrangement, the armrests 57 are a smaller distance apart than the handles 27 and are overlapped by a protruding shoulder on each transverse bar, so that the tray 55 is supported on the armrests 57 and is thereby held better. In particular the tray 55 can now be moved forward quite a way.

The table which can be inserted between the side sections can advantageously be made in the form of a folding table as shown in FIG. 19.

On the lower side of each half 72 of the table, made up of slats 71, a rectangular frame 74 is provided. The cross-member 70 of each frame has three recesses 75. The two recesses provided at the ends are in the same positions as the corresponding recesses 41 on the side sections 1 beneath the armrests, so that the folded table can be secured by horizontal members pushed through. On the other hand, if the folding table is unfolded, then the two middle recesses 75 are in the same position as the corresponding recesses 41 on the side sections, so that the unfolded table can be locked onto the side sections.

Each half of the folding table also has a pair of supports 76 attached to it which can move in and out like scissors. The supports 76 comprise table legs 79 which are attached at their upper ends to a main bar 78 by means of a bolt 77 which is inserted therethrough, this main bar being provided on the inner sides of the cross-members 70. In the middle portion of each of the legs an arm 80 is pivoted, the upper end of which arm is pivoted on the associated frame. Thus, when the table swings out it is securely supported by the two supports 76. However, when folded in, the two supports 76, including the arm 80, fit exactly into the frames 74 respectively and do not protrude above them, so that the two halves of the table are immediately folded together. In the same way a so-called long table can also be formed with a pair of folding legs, which is thus not supported in two folding table-top halves. Preferably with such a "long table" a greater number of recesses for the horizontal members are provided at a predetermined spacing so that the long table can be locked on to the side sections in various positions, as required.

I claim:

1. Combination furniture comprising:

vertical frame-like side sections (1) of similar construction, each having a front leg and a back leg, an upper horizontal strut (14) defining an arm rest and a lower horizontal strut (11), each of which struts are connected to the front leg and back leg;

cross ties (2) each inserted between a pair of front legs and a pair of back legs;

connections between said cross ties (2) and said legs comprising plugs (10) engaging bore holes in said legs and a securing bolt means (8) clamping the cross ties to the legs;

a folding seat including a seat section (3a) and a back section (3b), that can be inserted between the two side sections above said cross ties;

a hinge (21) connecting the seat section and the back section adjacent each side thereof, said hinges (21) having laterally protruding pivot pins (23), wherein said side sections have recesses (12) in the top of each lower horizontal strut (11) for receiving said laterally protruding pivot pins, and means (16, 35, 37) adjustably securing the seat section and the back section to the side sections at locations on the seat section and back section remote from said hinges (21); and a further furniture module secured to at least one other side of said side sections using further cross ties that are secured to said side sections in the same manner as said cross ties inserted between said legs.

2. The combination furniture according to claim 1 wherein each cross tie consists of two struts positioned one above the other and connected with each other by means of a cross piece, said cross tie having a pair of plugs engaging bore holes in said legs and wherein the cross piece is formed with a bore hole between said pair of plugs in alignment with a bore hole in the abutting leg for receiving a securing bolt means.

3. The combination furniture according to claim 1 wherein the axis of said pivot pins is located in the region of the upper side of the seat section and back section.

4. The combination furniture according to claim 1 wherein said seat section and back section of said folding seat is adjustably attached to said side sections by cables.

5. The combination furniture according to claim 1 wherein the further furniture module includes a further folding seat of a construction similar to that of claim 1.

6. The combination furniture according to claim 1 wherein the further furniture module includes a table.

7. The combination furniture according to claim 6 including at least four horizontally spaced side sections and containing a pair of folding seats with a table top positioned between them.

8. The combination furniture according to claim 6 wherein said table is one of square, rectangular, triangular, or trapezoidal and the adjacent side sections are correspondingly angled.

9. The combination furniture according to claim 1 wherein said furniture has wheels provided at one end thereof and handles at the other.

* * * * *